United States Patent [19]

Frisbee

[11] 4,074,770

[45] Feb. 21, 1978

[54] ANGLE CONTROL FOR DOZER BLADE

[75] Inventor: Claude M. Frisbee, Bettendorf, Iowa

[73] Assignee: J. I. Case Company, Racine, Wis.

[21] Appl. No.: 802,769

[22] Filed: June 2, 1977

Related U.S. Application Data

[63] Continuation-in-part of Ser. No. 670,606, March 26, 1976, abandoned.

[51] Int. Cl.[2] ..... E02F 3/76

[52] U.S. Cl. ..... 172/804

[58] Field of Search ..... 172/802–808; 92/61

[56] References Cited

U.S. PATENT DOCUMENTS

| | | | |
|---|---|---|---|
| 2,687,586 | 8/1954 | Dickinson | 172/805 |
| 2,943,407 | 7/1960 | Long | 172/804 |
| 3,368,478 | 2/1968 | Clar | 100/245 X |
| 3,386,519 | 6/1968 | Long | 172/805 |
| 3,606,929 | 9/1971 | Frisbee | 172/804 |
| 3,628,612 | 12/1971 | Liess | 172/805 |
| 3,645,340 | 2/1972 | Fisbee | 172/805 |

*Primary Examiner*—Richard J. Johnson
*Attorney, Agent, or Firm*—Cullen, Settle, Sloman & Cantor

[57] ABSTRACT

An angle control, particularly for a bulldozer or tractor blade having a U-shaped frame, including a pair of piston-cylinders on each side of the vehicle and a hydraulic control. The cylinders of each pair of piston-cylinders are rigidly connected in vertically stacked overlapping relation above the side portions of the U-shaped frame with the piston rods extending in opposite directions. One piston rod of each pair is operably connected to one side of the blade and the opposed piston rods are connected to the frame. The control simultaneously extends one pair of piston-cylinders while retracting the opposed pair to angle the blade about a vertical axis. In one embodiment, the piston rods are solid with the hydraulic control including flexible lines connected to the hydraulic cylinders. In the other embodiment, the rearwardly extending piston rods are hollow having passages to the head and rod ends of the hydraulic cylinders.

6 Claims, 6 Drawing Figures

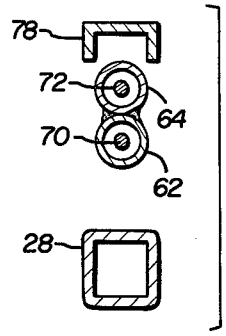
FIG. 2
FIG. 1
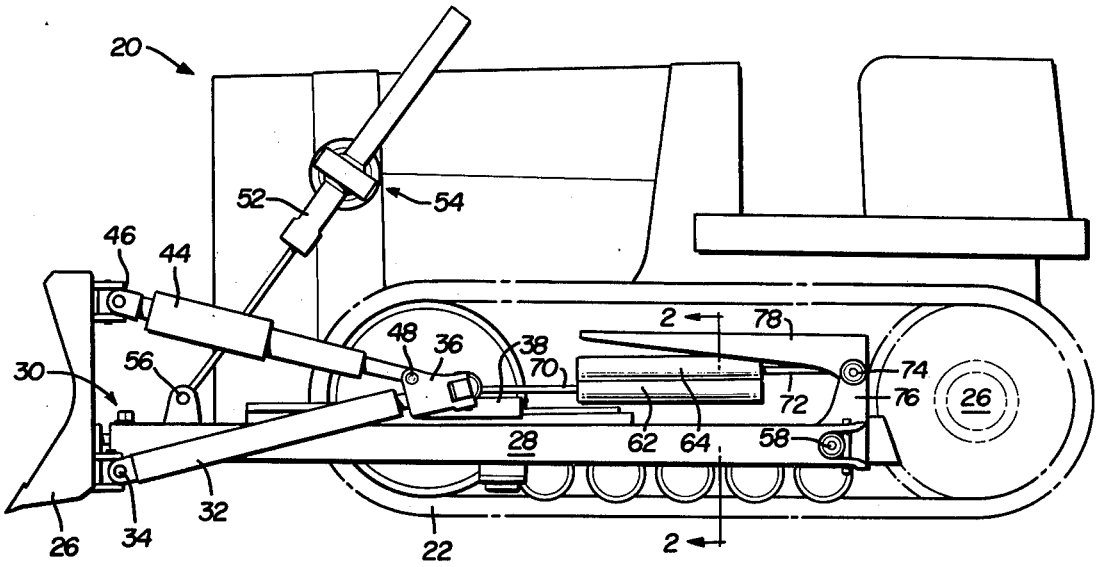
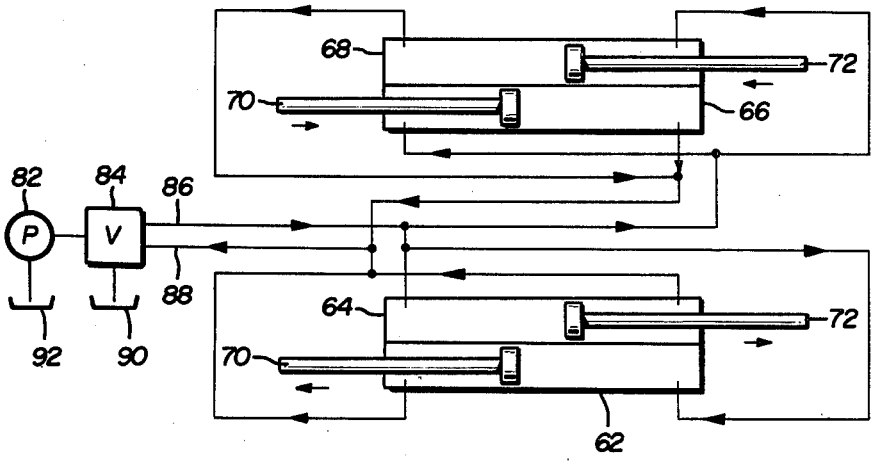
FIG. 3

ANGLE CONTROL FOR DOZER BLADE

RELATED APPLICATIONS

This application is a continuation-in-part application of my pending application for U.S. patent, Ser. No. 670,606, filed Mar. 26, 1976, now abandoned.

FIELD OF THE INVENTION

The present invention relates to bulldozers or the like having transversely extending blades and more particularly to means for adjusting the blade about a vertical axis, commonly referred to as angling.

The blade of an angling bulldozer is generally supported on a U-shaped frame which is pivotally connected adjacent its ends to the sides of the bulldozer as shown in U.S. Pat No. 2,943,407 which is assigned to the assignee of the instant application. The blade is supported adjacent its midportion to the center of the frame and the opposed sides are connected to hydraulic cylinders for angling the blade. One angle cylinder is extended while the opposed cylinder is retracted to adjust the blade about a vertical axis.

At present, there are two types of angling controls, including the solid rod end mounted piston-cylinders shown in the above referenced U.S. Pat. No. 2,943,407 and the hollow rod-trunnion mounted piston-cylinders shown in my U.S. Pat. No. 3,606,929. In the solid rod angle piston-cylinders, the hydraulic cylinders are pivotally connected to the bulldozer and the rods extend forwardly to angle the blade. In the hollow rod-trunnion mounted angle piston-cylinders, the rod end of each angle cylinder is pivotally connected to the bulldozer and the cylinder portion extends forwardly to angle the cylinder. The hydraulic control is then connected to the hollow piston rods to actuate the piston-cylinders. The hollow rod-trunnion mounted angle cylinders are presently preferred because of the simplicity of the hydraulic control and for the reasons set forth in my above referenced patent. The disadvantages of the hollow rod-trunnion mounted cylinders are cost and maintenance. The relatively long hollow piston rod is substantially more expensive than a more conventional solid piston rod. Further, at the maximum angle of the bulldozer blade, wherein one hydraulic cylinder has been fully extended, the cylinder end extends past the forward end of the frame, making it vulnerable to damage in dozer operation. The disadvantages of the solid rod, end mounted angle cylinders are (1) a limited degree of angle or angle stroke, and (2) a low column strength at maximum angle, i.e., full extension of one piston rod.

These disadvantages of the present bulldozer angle controls have resulted in the improved angle control of the present invention. The angle control of the present invention utilizes two relatively short piston-cylinders secured together with the rod ends extending in opposite directions. This arrangement eliminates many of the problems of the prior art as described hereinbelow.

SUMMARY OF THE INVENTION

The angle control of the present invention may be utilized in a conventional bulldozer having a side mounted frame such as the U-shaped frame disclosed in U.S. Pat. No. 2,943,407, wherein the blade is mounted on the frame for angling movement about a vertical axis. The angling control of the present invention includes a pair of piston-cylinders mounted in parallel relation on opposite sides of the bulldozer with the piston rods extending in opposite directions. One piston rod of each pair is connected to the bulldozer and the opposed piston rod of each pair is operably connected to one side of the bulldozer blade. The hydraulic control for the angle cylinders interconnects the cylinders of each pair and the pairs of piston-cylinders to simultaneously extend the piston rods of one pair while retracting the piston rods of the opposed pair to angle the bulldozer blade about the vertical axis.

In one preferred embodiment of the angle control of this invention, the rearwardly extending piston rod of each pair of piston-cylinders is hollow, having two fluid passages. One fluid passage extends to the rod end of the fluid cylinder and the other fluid passage extends to the head end. In the hollow rod piston-cylinder control of the present invention, the control lines extend from the vehicle to the rearwardly extending piston-rods and the control lines may be rigid. In the other embodiment, the control lines are flexible and extend to the fluid cylinders.

In either embodiment, the fluid control includes a source of fluid under pressure, such as a hydraulic fluid pump, a flow line from the source of fluid pressure to a valve and a pair of branch lines from the valve to the cylinders on each side of the vehicle. One branch line is interconnected with the head end of both cylinders on one side of the vehicle and with the rod end of both cylinders on the opposed side of the vehicle. The other branch line is interconnected with the rod end of both cylinders on the first side of the vehicle and with the head end of both cylinders on the opposed side. Thus, either pair of piston-cylinders may be extended, while the opposed pair of piston-cylinders is retracted to angle the blade about a vertical axis.

The dual piston-cylinder angle control of the present invention has several unexpected advantages in a scraper blade control, such as a bulldozer blade, over the prior art. For example, when a bulldozer blade is angled, the leading edge of the blade has the greatest load and therefore the fully extended piston-cylinder in an angle control is subjected to flexure. Flexure of an extended cylinder under load may ruin the seals, requiring replacement or repair of the cylinder. The utilization of two smaller piston-cylinders reduces the required extension, thereby reducing flexure and damage to the cylinders.

Further, the diameter of the hydraulic cylinders in an angle control may be reduced by using two pairs of piston-cylinders as disclosed. A single piston-cylinder having the same force as a pair of piston-cylinders would have a diameter greater than the width of the supporting frame. Therefore, the utilization of two pairs of vertically stacked piston-cylinders results in an important advantage. The supporting frame protects the cylinders from damage. Further, as described, greater angling force may then be obtained with two cylinders.

Another unique advantage of the two pairs of piston-cylinders used in the angle control of the present invention results during the normal operation of the blade. A bulldozer blade, for example, is normally set prior to dozing. That is, the blade is angled to the desired position before the bulldozer is moved. The piston-cylinders are thereby subjected to relatively large compressive loads while the piston-cylinders must remain stationary. The compressive force which a piston-cylinder will resist without movement is proportional to the area of the head. As will be understood, however, the head area is greater with two pairs of piston-cylinders than with one piston-cylinder on each side. Therefore, the angle control of the present invention will support greater dozing loads without leakage of the piston-cylinders.

The angle control of the present invention thereby permits the use of two relatively short piston cylinders and eliminates many of the problems of the prior art. Where hollow rod cylinders are utilized, the hollow rods are relatively short and therefore less expensive and the cylinder portions do not extend beyond the forward corner of the frame assembly. Further, the double acting pairs of piston-cylinders extend the angle of the blade by reducing the angle stroke and increases the column strength of the cylinders at maximum angle.

In the preferred embodiment of the bulldozer blade angle control, the side edges of the blade are connected to the frame assembly by structural members, such as the pistons and struts disclosed in my above referenced patent. The structural members are connected at one end to the side of the blade and pivotally connected at the opposed end to a slide mounted on the frame. One piston rod of each pair of cylinders is connected to the slide and the opposed rod is connected to an anchor bracket adjacent the rear of the U-frame. The anchor bracket in the disclosed embodiment includes an upright member connected to the frame and a guard or shield extending forwardly over the angle cylinders.

Other advantages and meritorious features of the angle control of the present invention will be more fully understood from the following description of the preferred embodiments, the appended claims and the drawings, a brief description of which follows.

BRIEF DESCRIPTION OF THE DRAWINGS

FIG. 1 is a side elevation of a conventional bulldozer having the improved angle control;

FIG. 2 is a partial end cross-sectional view of the angle control shown in FIG. 1, in the direction of view arrows 2—2;

FIG. 3 is a schematic view of one embodiment of the hydraulic control for the angle control of this invention;

DESCRIPTION OF THE PREFERRED EMBODIMENTS

Figure 4:
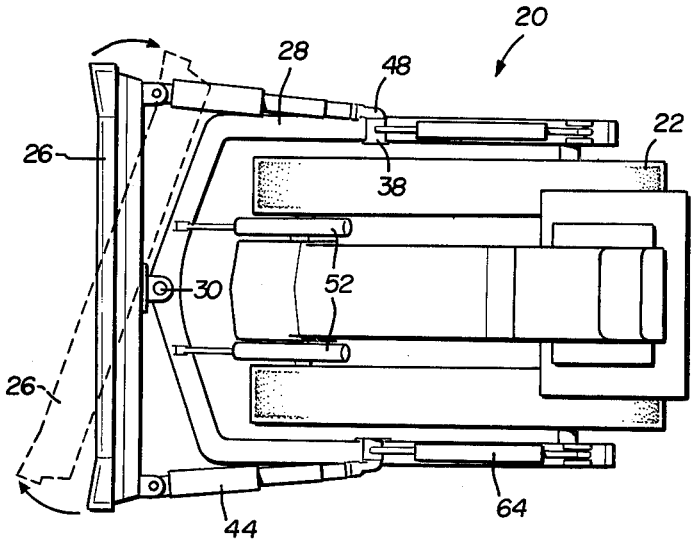
FIG. 4 is a top elevation of a conventional bulldozer, similar to FIG. 1, having the improved angle control.

A crawler tractor or bulldozer 20 having one embodiment of the angle control means of the present invention is shown in FIGS. 1 and 4. It will be understood however that the angle control of the present invention may be utilized in other implements having the prior art problems described hereinabove. For example, the angle control of the present invention may be utilized in a wheeled vehicle or tractor. The following description will however be limited to a bulldozer of the type shown for simplicity of illustration.

The disclosed bulldozer includes continuous tracks 22 which are supported on transverse axles 24. The bulldozer includes a conventional transverse scraper blade 26 which is supported on a C- or U-shaped frame assembly 28. The midportion of the blade may be supported on the frame by a ball joint assembly 30 as disclosed in my prior U.S. Pat. No. 3,645,340.

The lower sides of the blade are supported by opposed struts 32 which are connected to the lower side corners of the blade by universal joints 34. The rearward ends of the struts 32 are connected to brackets 36 which are pivotally connected to slides 38. The slides, in turn, are slideably connected on slide tracks 40. The upper corners of the blade are connected to slides 36 by pitch-tilt cylinders 44 which are connected to the upper corners of the blade by universal joints 46. The rearward ends of pisons 44 are connected to brackets 36 by pivot connections 48.

In the embodiment of the bulldozer control shown in FIGS. 1 and 4, the blade may be pitched about the horizontal axis of ball joint 30 by simultaneously extending opposed pitch-tilt cylinders 44. The blade may be tilted about the longitudinal axis of the bulldozer by extending one piston 44 and retracting the opposed piston. The blade in the disclosed embodiment may be raised and lowered by lift piston-cylinders 52. The cylinders 52 are pivotally secured to the sides of the bulldozer by trunnion mountings 54. The piston rods are connected to the bulldozer frame by pivotal connections 56. The opposed ends of the C- or U-shaped frame are pivotally connected to the bulldozer by pivotal connections 58. The blade is thus raised by retracting piston-cylinders 52, wherein the frame and the supported blade are raised by pivoting the frame about axis 58.

The blade of the bulldozer may thus be pitched or tilted by operation of piston-cylinders 44, raised or lowered by operation of piston-cylinders 52 and angled as described below about the vertical axis of the center ball joint 30. It will be understood that the angle control of the present invention may also be utilized in an angle-pitch bulldozer such as disclosed in U.S. Pat. No. 2,942,363, an angle-tilt bulldozer such as disclosed in the above referenced U.S. Pat. No. 2,943,407 or the disclosed pitch, angle tilt bulldozer described herein. Details of the control mechanism and structure necessary for pitching, tilting and raising the bulldozer may be found in more detail in my above referenced U.S. Pat. No. 3,645,340.

The embodiment of the angle control shown in FIGS. 1 to 3 includes one pair of piston-cylinders 62 and 64 on the left hand side of the bulldozer and a second pair of piston-cylinders 66 and 68 on the right hand side of the bulldozer. The cylinder portions may be welded or otherwise secured in side to side relation as shown in FIGS. 1 and 2, with the piston rods extending in opposite directions. One piston rod 70 of each pair of piston-cylinders extends forwardly and the opposed piston rod 72 extends rearwardly. The forwardly extending piston rods 70 are are pivotally connected to bracket 36 of slide 38 and the rearwardly extending piston rods 72 are pivotally connected at 74 to bracket 76. In the disclosed embodiment, an upstanding bracket 76 is connected to frame 28 by welding or other suitable means and a channel-shaped guard is pivotally connected at 74 to the bracket 76. The channel-shaped guards 78 will thereby protect the angle cylinders during operation, but may be removed during servicing.

One embodiment of a hydraulic control for the angle-cylinders of FIGS. 1 and 2 shown in FIG. 3. As shown, pump 82 is connected to two-way valve 84. When actuated to angle the bulldozer blade 26 in a clockwise direction, pump 82 pumps hydraulic fluid through valve 84 into line 86. As shown, the hydraulic fluid is thereby received in the rod end of cylinders 66 and 68 to simultaneously retract piston rods 70 and 72 on the right hand side of the bulldozer. Simultaneously, hydraulic fluid is pumped into the head end of cylinders 62 and 64 to extend piston rods 70 and 72 on the left hand side of the bulldozer. The left hand slide 38 is thus extended forwardly and the right hand slide is retracted rearwardly to angle the bulldozer blade 26 in a clockwise direction. The hydraulic fluid in the head end of cylinders 66 and 68 and the rod end of cylinders 62 and 64 is thereby returned through line 88, through valve 84, into reservoir 90. As shown, the pump also includes a reservoir 92 as is conventional.

Similarly, the valve 84 may be set to pump hydraulic fluid through line 88 into the head end of cylinders 66 and 68 and the rod end of cylinders 62 and 64 to angle the bulldozer blade 26 in a counterclockwise direction. In this setting of the valve, line 86 serves as a return line. Finally, the valve 84 may be set in a neutral position, wherein fluid is pumped into reservoir 90. The embodiment of the angle control shown in FIGS. 1 to 4 thus utilizes two relatively small conventional solid-rod, double acting piston-cylinders of substantially the same size. In certain applications however piston-cylinders of different sizes may be preferred. The control lines 86 and 88 to the hydraulic cylinders are flexible hydraulic lines extending from the bulldozer to the hydraulic cylinders. The lines must be flexible because the cylinders 62 to 68 move relative to the bulldozer. In the embodiment of the angle control shown in FIGS. 5 and 6, the lines may be relatively rigid conduits because the lines are connected to the piston rods as described below.

Figure 5:
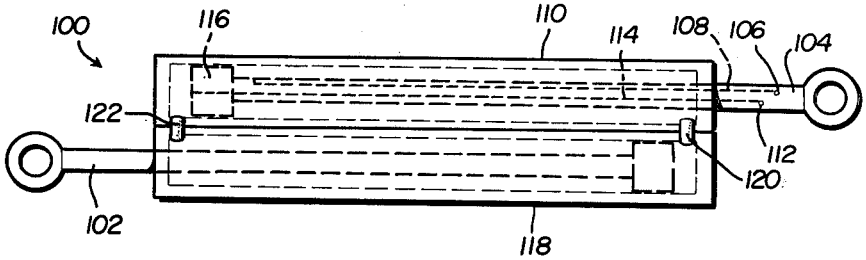
FIG. 5 is a side elevation of a pair of angle control piston-cylinders having a hollow piston rod.
Figure 6:
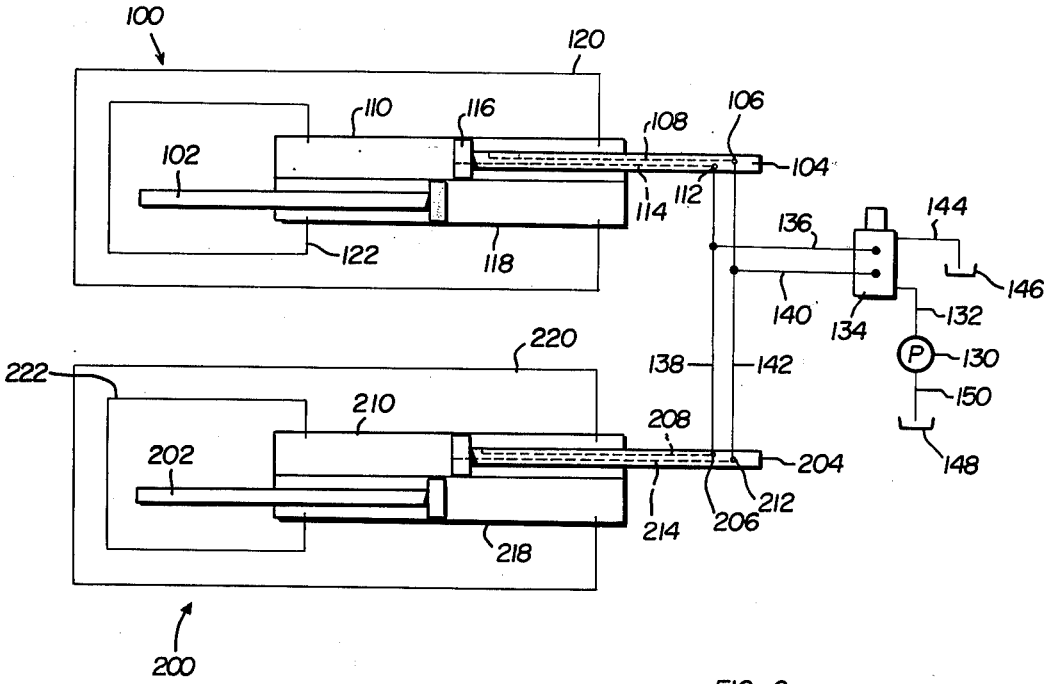
FIG. 6 is a schematic view of a second embodiment of the hydraulic control using hollow rod piston-cylinders similar to FIG. 5.

The second preferred embodiment of the angle control of this invention will be understood from FIGS. 5 and 6, wherein FIG. 5 illustrates one embodiment of a hollow-rod piston control and FIG. 6 is a schematic hydraulic circuit utilizing the hollow-rod piston-cylinder disclosed in FIG. 5. As described, the angle control of this invention utilizes two pairs of piston-cylinders, one pair being shown at 100 in FIG. 5. The forwardly extending piston rod 102 is solid as described above. The rearwardly extending piston rod 104 includes a first fluid port 106 connected by passage 108 to the rod end of fluid cylinder 110. The second fluid port 112 is connected by fluid passage 114 to the head end of the fluid cylinder 110. As viewed in FIG. 5, the rod end of fluid cylinder 110 is to the right of piston head 116 and the head end of cylinder 110 is to the left of the piston head. The passage 114 thus passes through the piston head 116. In the disclosed embodiment, the rod end of fluid cylinder 110 is connected by line 120 to the head end of cylinder 118 and the head end of cylinder 110 is connected by line 120 to the rod end of cylinder 118 for the purposes described below. Except as described, the piston-cylinders 110 and 118 may be conventional hydraulic piston-cylinders with the cylinder portions rigidly connected together as by welding.

The operation of the hydraulic control circuit shown in FIG. 6 is similar to the circuit of FIG. 3. The control includes a fluid pump 130 connected by line 132 to valve 134. The valve is connected by line 136 to first line 138 interconnecting port 112 of piston rod 104 with port 206 of piston rod 204. The second pair of piston-cylinders 200 are numbered in the same sequence as piston-cylinders 100. Thus, port 206 is connected by passage 108 to the rod end of piston 210 and port 212 is connected by passage 214 to the head end of fluid cylinder 210. Similarly, the rod end of cylinder 210 is connected by line 220 to the head end of cylinder 218 and the head end of cylinder 210 is connected by line 222 to the rod end of cylinder 218. The valve is also connected by line 140 to the second line 142 which interconnects port 106 of piston rod 104 with port 212 of piston rod 204. Finally, valve 134 is connected by line 144 to reservoir 146. The pump is also connected to a reservoir 148 by line 150.

The operation of the hydraulic control shown in FIG. 6 is therefore as follows. Assuming that the first pair of piston-cylinders 100 is connected on the right side of the bulldozer 20 shown in FIG. 4 and the second pair 200 is connected on the left side, the bulldozer blade 26 is angled to the right in a clockwise direction as shown in phantom in FIG. 4 by setting valve 134 to open the communication between line 132 to the pump 130 and line 140 to second line 142. As described above, line 142 is connected to port 106 of piston rod 104 to the rod end of cylinder 110 through line 108. Piston rod 104 is thus retracted and hydraulic fluid is forced through line 122 to the rod end of piston-cylinder 118, retracting piston rod 102. The piston rods of piston-cylinders 100 are thus both retracted. Similarly, the rods of piston-cylinders 200 are extended. Line 142 is connected to port 212, which is connected by line 214 to the head end of cylinder 210. The rod 204 is thus extended, forcing hydraulic fluid through line 220 to the head end of cylinder 218. Viewed from the top of the bulldozer, as shown in FIG. 4, the left angle piston-cylinder is thus extended and the right angle piston-cylinder is retracted to angle the bulldozer blade in a clockwise direction as shown in phantom. The blade may be angled to the left in a counterclockwise direction by setting valve 134 to interconnect line 136 with line 132 to pump 130. Alternatively, the valve is set in neutral by interconnecting line 132 and 144 to reservoir 146.

As described above, the hollow rod embodiment of the angle control shown in FIGS.5 and 6 has an additional advantage. The hydraulic lines from the bulldozer to the angle control cylinders may be rigid pipes, interconnected between the bulldozer and the rearwardly extending piston rods, to ports 106, 112 206 and 212. The hollow rod angle cylinders of FIGS. 5 and 6 also have several advantages over the hollow rod angle cylinders presently used. The shorter hollow piston rods 104 and 204 are substantially less expensive than the longer hollow piston rods presently used. It should be noted that the forwardly extending piston rods are solid. Second, the requirement of trunnion mounting has been eliminated and the fluid cylinders do not extend beyond the forward end of the frame. In the preferred embodiment of the piston-cylinders shown in FIG. 5, the cylinder portions are vertically stacked to prevent damage to the cylinders as described above.

Having described the improved angle control of the present invention and its operation in detail, what is claimed is:

1. In a vehicle having a U-shaped frame surrounding the forward end of said vehicle and a transverse scraper blade pivotally mounted on a vertical axis adjacent its midportion to the forward end of said frame, each side of said blade operably connected to said frame by a structural means permitting angling of said blade about said vertical axis, the improvement comprising: an angle control on each side of said vehicle, each of said angle controls comprising a pair of fluid operated piston-cylinders each having a pair of rigidly interconnected overlapping fluid cylinders and each cylinder having an extensible piston rod, said fluid cylinders vertically stacked above the side portions of said U-shaped frame with said piston rods extending in opposite directions, one piston rod of each pair extending rearwardly and operably connected to said frame and the opposed piston rod of each pair connected to said structural means by a universal connection, and a fluid control including a source of fluid under pressure, a flow line from said source to a valve, and a pair of branch lines from the valve to the cylinders on each side of said vehicle, one branch line being interconnected with the head end of both cylinders on one side of the vehicle and with the rod end of both cylinders on the opposed side of said vehicle, and the other branch line being interconnected with the rod end of both cylinders on said one side of said vehicle and with the head end of both cylinders on said opposed side of said vehicle, such that operation of said fluid control means extends both piston rods of one pair of piston-cylinders while simultaneously retracting the piston rods of the opposed pair of piston-cylinders with the vertically stacked fluid cylinders and piston rods extensible and retractable within the vertical projection of said frame side portions to angle said blade about said vertical axis and said frame protecting said fluid-cylinders.

2. The angle control defined in claim 1, characterized in that said frame includes a guard frame on each side of said vehicle, said guard frame including an upright member secured to said frame and a forwardly extending guard overlying said vertically stacked fluid cylinders, said rearwardly extending piston rods pivotally connected to said upright members.

3. The angle control defined in claim 1, characterized in that said rearwardly extending piston rods are hollow and said fluid control includes a line from said valve to said hollow piston rods.

4. The angle control defined in claim 3, characterized in that each of said hollow piston rods include separate lines to said head and rod ends of said rearwardly extending piston-cylinders.

5. In a vehicle having a U-shaped frame surrounding the forward end of said vehicle and a transverse scraper blade pivotally mounted on a vertical axis adjacent its midportion to the forward end of said frame, each side of said blade connected to an angle control by a strut assembly pivotally connected to said blade, said angle control comprising: a pair of fluid operated piston-cylinders on each side of said vehicle, each pair of piston-cylinders having a pair of rigidly interconnected overlapping fluid cylinders and each cylinder having an extensible piston rod, said piston rods extending in opposite directions, one piston rod of each pair extending rearwardly and connected to said frame and the opposed piston rod extending forwardly and connected to said strut assembly by a universal connection, said rearwardly extending piston rods each having two fluid ports, one port connected by a fluid line to the head end of the fluid cylinder and the other port connected by a fluid line to the rod end of said cylinder, and a fluid control including a source of fluid under pressure, a flow line from the source of fluid pressure to a valve, and a pair of branch lines from the valve to the piston-cylinders on each side of said vehicle, one branch line interconnected with the head end of both cylinders on one side of said vehicle through said rearwardly extending piston rod and with the rod end of both cylinders on the opposed side of said vehicle, through the opposed rearwardly extending piston rod, and the other branch line being interconnected with the rod end of both cylinders on said one side of said vehicle and with the head end of both cylinders on the opposed side of said vehicle through said rearwardly extending piston rods, such that operation of the control means extends both piston rods on one pair of piston-cylinders, while simultaneously retracting the piston rods of the opposed pair of piston-cylinders, thereby extending one side of said blade forwardly and the opposed side rearwardly to angle said blade about said vertical axis.

6. The angle control defined in claim 5, characterized in that said fluid cylinders are vertically stacked above the side portions of said U-shaped frame and said angle control includes flexible lines extending from said valve to said rearwardly extending piston rods, said fluid control extending and retracting said piston rods and said vertically stacked cylinders within the vertical projection of said frame, said frame thereby protecting the piston-cylinders from damage.

* * * * *